US006412319B1

(12) United States Patent
Adelmeyer et al.

(10) Patent No.: US 6,412,319 B1
(45) Date of Patent: Jul. 2, 2002

(54) LOCKSET HAVING KEYED EGG-SHAPED KNOB

(75) Inventors: Gerard G. Adelmeyer, Monarch Beach; Gerald B. Chong, Rowland Heights, both of CA (US)

(73) Assignee: Emhart LLC, Newark, DE (US)

( * ) Notice: Subject to any disclaimer, the term of this patent is extended or adjusted under 35 U.S.C. 154(b) by 12 days.

(21) Appl. No.: 09/636,432

(22) Filed: Aug. 11, 2000

Related U.S. Application Data

(60) Provisional application No. 60/148,921, filed on Aug. 13, 1999.

(51) Int. Cl.[7] ..... E05B 13/10

(52) U.S. Cl. ..... 70/224; 70/57; 70/174; 70/207; 70/215; 70/216; 70/221; 70/347; 70/367; 70/369; 70/448; 70/449; 70/450; 70/DIG. 39; 292/347

(58) Field of Search ..... 70/224, 207, 367, 70/369, 174, 57, 370, 347, DIG. 39, 215, 216, 221, 442, 449, 450; 292/347

(56) References Cited

U.S. PATENT DOCUMENTS

| | | | | | |
|---|---|---|---|---|---|
| 337,093 | A | * | 3/1886 | Thistle | 292/347 |
| 651,552 | A | * | 6/1900 | Monz | 292/347 |
| 1,992,126 | A | * | 2/1935 | Hurd | 70/224 |
| 1,996,357 | A | * | 4/1935 | Voight | 292/347 |
| 2,082,351 | A | * | 6/1937 | Moore | 70/224 |
| 2,713,257 | A | * | 7/1955 | McConnell et al. | 70/224 |
| 4,394,821 | A | | 7/1983 | Best et al. | |
| 4,428,570 | A | | 1/1984 | Forshee et al. | |
| 4,435,967 | A | | 3/1984 | Best et al. | |
| 4,765,163 | A | | 8/1988 | Trull et al. | |
| 4,876,783 | A | | 10/1989 | Campion et al. | |
| 4,995,249 | A | | 2/1991 | Preissler et al. | |
| 5,036,575 | A | * | 8/1991 | Campion et al. | 29/401.1 |
| 5,077,994 | A | | 1/1992 | Trull et al. | |
| 5,335,950 | A | * | 8/1994 | Mirshaflee et al. | 292/356 |
| 5,398,531 | A | | 3/1995 | Shen | |
| 5,586,459 | A | | 12/1996 | Bullock et al. | |
| 5,611,226 | A | * | 3/1997 | Fata | 70/454 |
| 5,685,583 | A | | 11/1997 | Meck et al. | |
| 5,688,005 | A | | 11/1997 | Ellis | |
| 5,749,612 | A | | 5/1998 | Meck et al. | |
| 5,752,399 | A | | 5/1998 | Shen | |
| 5,782,119 | A | * | 7/1998 | Ellis et al. | 70/371 |
| 5,947,537 | A | | 9/1999 | Aigner et al. | |

FOREIGN PATENT DOCUMENTS

| | | | | |
|---|---|---|---|---|
| DE | 569878 | A | * 11/1975 | 70/216 |

* cited by examiner

*Primary Examiner*—Suzanne Dino Barrett
*Assistant Examiner*—Carlos Lugo
(74) *Attorney, Agent, or Firm*—Harness, Dickey & Pierce, P.L.C.

(57) ABSTRACT

A keyed knob assembly (10) having a knob portion (12), a knob insert (14) partially received within a bore (18) formed in the knob portion (12) and a shank portion (16) partially covering the knob insert (14) is disclosed. A throughbore (48) formed in the knob insert (14) is provided which operably supports a locking cylinder assembly (42). An axial channel (50) formed in the shank portion (16) terminates at a radial slot (52) to provide a means for releasably coupling the knob,assembly (10) of the present invention to a catch (54) of a lever catch subassembly associate with the chassis of the lockset.

17 Claims, 3 Drawing Sheets

LOCKSET HAVING KEYED EGG-SHAPED KNOB

This application claims priority from provisional application Ser. No. 60/148,921, filed Aug. 13, 1999.

BACKGROUND AND SUMMARY OF THE INVENTION

The present invention relates generally to door hardware, and more particularly to a knob assembly configuration for an entry door lockset.

The present invention is directed to a knob assembly having a knob portion, a knob insert disposed within a bore formed in the knob portion and a shank portion which is releasably secured to the back of the knob portion for concealing the knob insert.

The present invention has the advantage of being readily adaptable to knob portions manufactured from various materials or in various styles with a shank portion adapted to complement the knob portion material and styling. Furthermore, the knob insert functions to align and position a cylinder lock assembly operably associated with the knob assembly. Furthermore, the shank portion is provided with certain local features which permit axial engagement of a catch mechanism associated with the chassis of the lockset.

The present invention provides considerable interchangeability with varying knob styles and materials and enhances accessibility to the cylinder assembly without having to pry apart finished components risking damage thereto. Moreover, the present invention permits shipping and distribution of a fully assembled knob assembly. Moreover, the use of die cast knob insert reduces the amount of machining which must be performed on the other components of the knob assembly.

DETAILED DESCRIPTION OF THE INVENTION

Figure 1A:
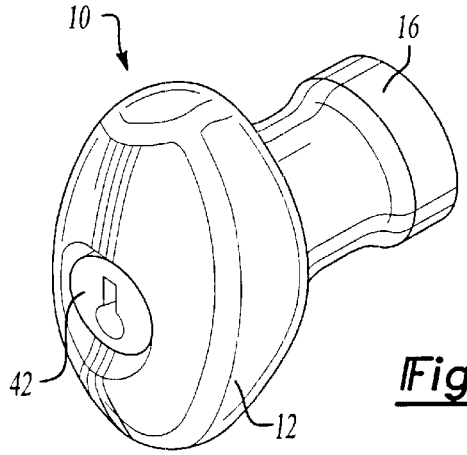
FIG. 1A is a front perspective view of a knob assembly in accordance with the present invention.

With reference to the figures, knob assembly 10 includes knob portion 12 having knob insert 14 and shank portion 16 releasably secured thereto. Knob portion 12 has an interior bore 18 formed from a back surface 20 thereof. A plurality of fastening apertures 22 are formed in back surface in a generally circumferential manner around bore 18. Knob insert 14 includes forward cylindrical flange 24, radial flanges 26 and rearward cylindrical flange 28. Shank portion 16 includes an oblong cover portion 30, cylindrical cover portion 32 and throughbore 34 formed therethrough.

Knob assembly 10 is assembled by inserting forward cylindrical flange 24 into bore 18 and releasably securing knob insert 14 to knob portion 12. In a presently preferred embodiment, threaded fasteners 36 are insert through apertures 27 formed in radial flanges 26 and received in apertures 22. Fasteners 36 utilized in the assembly are self-threading screws which facilitate assembly of the knob assembly. Throughbore 34 of shank portion 16 receives rearward cylindrical flange 28 such that oblong cover portion 30 abuttingly engages rear surface 20 and shank portion 16 is releasably secured to knob portion 12 and knob insert 16. In a presently preferred embodiment, threaded fastener 38 is inserted through aperture 40 formed in oblong cover portion 30 and received in aperture 22 formed near the bottom of rear surface 20 of knob portion 12.

Knob assembly 10 further includes locking cylinder assembly 42 operably disposed in knob portion 12 and knob insert 14 to permit locking capabilities for the lockset incorporating knob assembly 10. More specifically, locking cylinder 42 is of the type conventionally used in door locksets. Knob portion 12 and more specifically bore 18 includes chimney cavity 44 formed therein for receiving a portion of locking cylinder 42. Likewise, forward cylindrical flange 24 has a slot 46 therein which is adapted to align with chimney cavity 44 for accommodating locking cylinder assembly 42. Throughbore 48 formed in knob insert 14 receives and operably supports locking cylinder assembly 42 in knob assembly 10. Tab 49 extends radially from rear cylindrical flange 28 adjacent radial flange 26 and blocks chimney cavity 44 such that knob insert 14 releasably retains lock cylinder assembly 42 within knob portion 12.

Figure 1B:
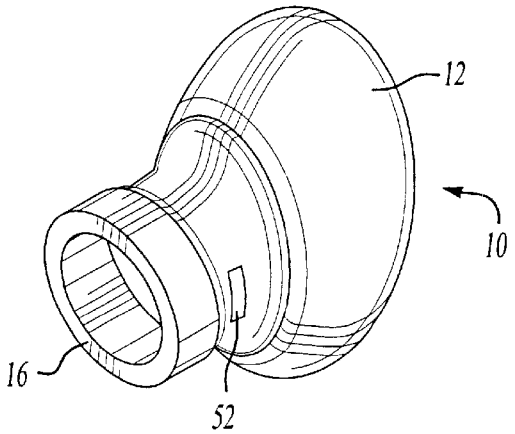
FIG. 1B is a rear perspective view of the knob assembly of the present invention.
Figure 3:
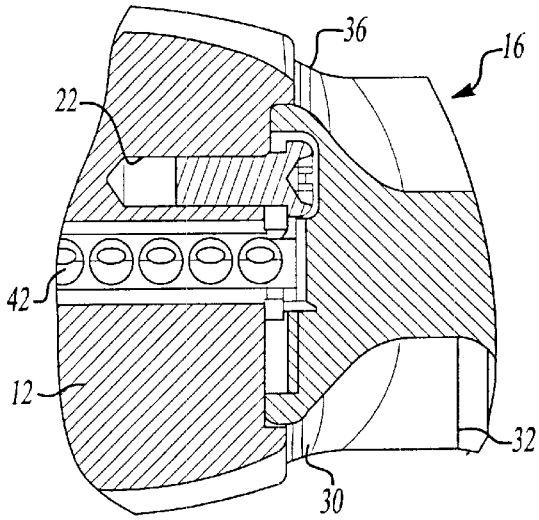
FIG. 3 is a detailed cross-sectional view taken through a portion of the knob assembly at the interface between the knob portion and the knob insert.
Figure 2:
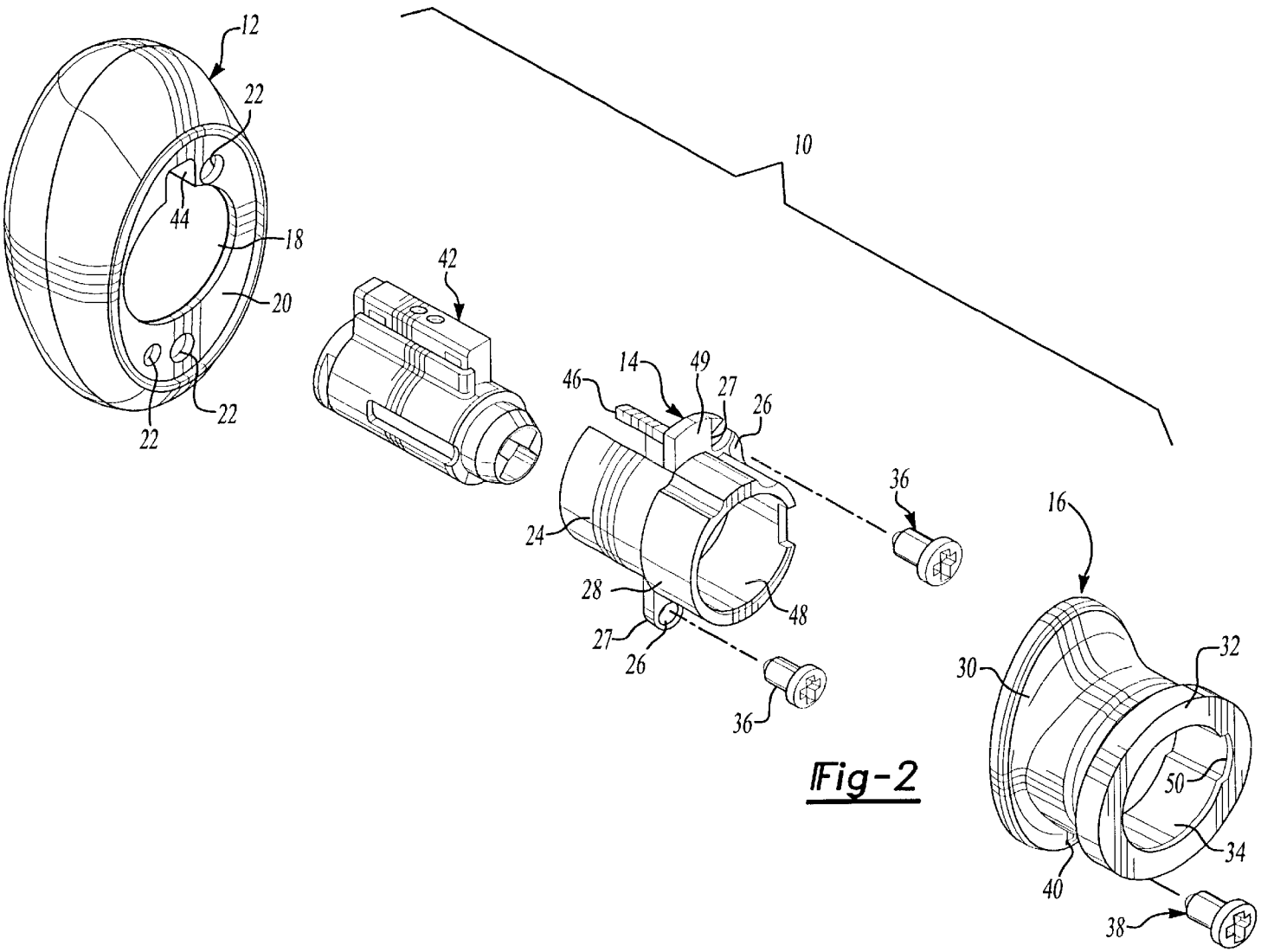
FIG. 2 is an exploded perspective view of the individual components of the knob assembly of the present invention.
Figure 4:
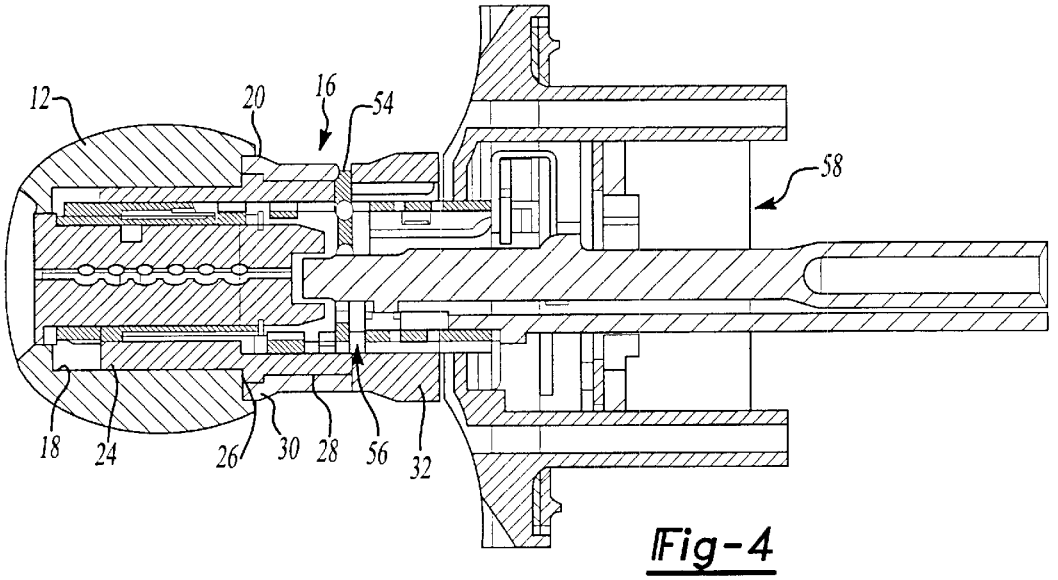
FIG. 4 is a top cross-sectional view of the knob assembly of the present invention operably coupled to a conventional lockset mechanism.
Figure 5:
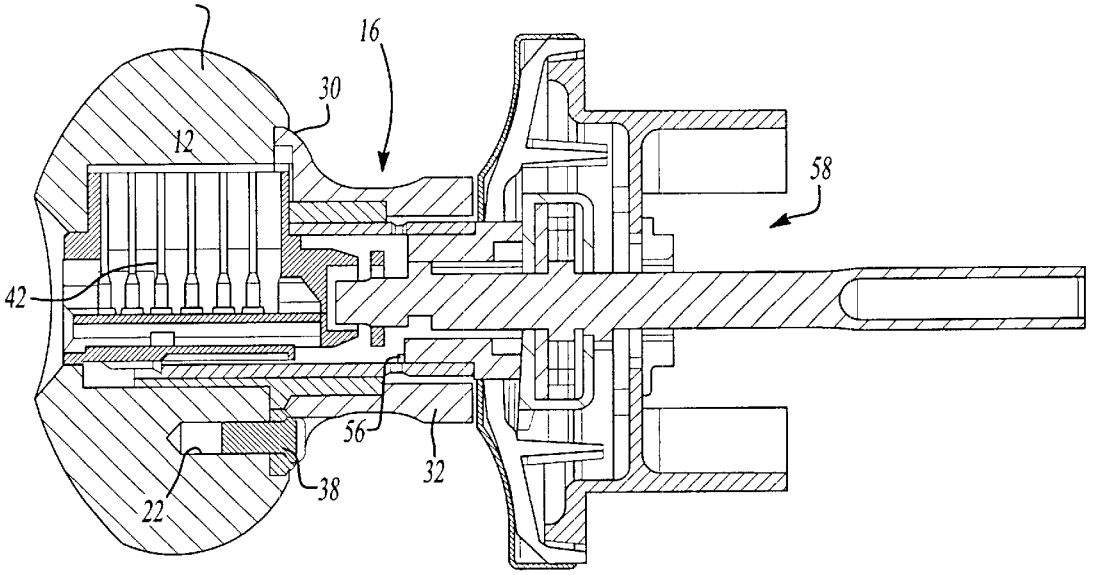
FIG. 5 is a side cross-sectional view of the knob assembly of the present invention operably coupled to a conventional lockset mechanism.

Knob assembly 10 and more particularly shank portion 16 is provided with a channel 50 formed in an inner annular surface defined by throughbore 34 in cylindrical cover portion 32. Channel 50 terminates at radial slot 52 (best seen in FIG. 1B and FIG. 4) which is adapted to receive a catch 54 extending from the lever catch subassembly 56 of chassis 58. Radial slot 52 formed in shank portion 16 provides a simple and effective means for releasably connecting knob assembly 10 to chassis 58. The preferred embodiment discloses a channel and slot formed in annular surface 34. However, the present invention also contemplates extending the length of rear cylindrical flange 28 and incorporating a channel and radial flange therein. More specifically, a channel may be formed in the bore 34 or alternately in bore 48 for receiving the lockset chassis. The channel terminates at a radial slot, whereby the catch of a lever catch subassembly engages the radial slot.

As presently preferred, knob portion 12 and shank portion 16 are forged brass components which are machined to provide the necessary features described and illustrated herein. Knob insert 14 is a die cast zinc component having the features described and illustrated herein are designed and manufactured such that adequate dimensional tolerancing is provided to minimize the amount of machining required to receive and adequately support locking cylinder assembly 42.

While the present invention has been described with particular reference to an egg-shaped knob assembly, one skilled in the art will readily recognize that the present invention has applicability to a keyed lockset assembly with knobs of various geometric configurations including round knob assemblies or lever assemblies. Similarly, the radial slot and lever catch assembly of the present invention has utility beyond the multi-piece knob assembly disclosed herein, and thus could be used in a variety of interior and exterior knob assembly applications. Furthermore, those skilled in the art will readily recognize from the foregoing discussion and accompanying drawings and claims, that changes, modifications and variations can be made therein without departing from the spirit and scope of the present invention as defined in the following claims.

What is claimed is:

1. A knob assembly comprising:

a knob portion having a rear surface formed thereon and a bore extending into said knob portion from said rear surface;

a knob insert releasably secured to said knob portion and having a first cylindrical flange received within said bore, a second cylindrical flange extending rearwardly from said first cylindrical flange, and a radial flange extending outwardly from said second cylindrical flange and engaging said rear surface, the radial flange including a first aperture formed therein adjacent said first cylindrical portion; and a shank portion having a throughbore formed therein for receiving said second cylindrical flange portion, a first cover portion adapted to engage said rear surface of said knob portion and a second cover portion extending axially away from said first cover portion, said shank portion being releasably secured to said knob portion such that said knob insert is captured therebetween.

2. The knob assembly of claim 1 wherein said rear surface has a second aperture formed therein adjacent said bore, said knob assembly further comprising a fastener extending through said first aperture and received in said second aperture to releasably secure said knob insert to said knob portion.

3. The knob insert of claim 2 further comprising a pair of radial flanges extending outwardly from said second cylindrical flange and engaging said rear surface, each of said pair of radial flanges having a first aperture formed therein adjacent said first cylindrical portion, and wherein said rear surface has a pair of second apertures formed therein adjacent said bore, said knob assembly further comprising a pair of fasteners extending through said first aperture and received in said second apertures to releasably secure said knob insert to said knob portion.

4. The knob assembly of claim 1 wherein said first cover portion of said shank portion has a first aperture formed therein adjacent said second cover portion, and wherein said rear surface has a second aperture formed therein adjacent said bore, said knob assembly further comprising a threaded aperture extending through said first aperture and received in said second aperture to releasably secure said shank portion to said knob portion.

5. The knob assembly of claim 1 wherein said shank portion has a channel formed on an inner annular surface defined by said throughbore which terminates at a radial slot, said radial slot adapted to receive a catch for releasably securing the knob assembly to a lockset chassis.

6. The knob assembly of claim 5 wherein said knob insert has a radial slot formed in an end of said second cylindrical flange which aligns with said radial slot formed in said shank portion.

7. The knob assembly of claim 1 wherein said knob portion is generally ellipsoidal.

8. A keyed knob assembly comprising:

a knob portion having a rear surface formed thereon and a bore extending into said knob portion from said rear surface;

a knob insert releasably secured to said knob portion and having a first throughbore, a first cylindrical flange received within said bore, a second cylindrical flange extending rearwardly from said first cylindrical flange, and a radial flange extending outwardly from said second cylindrical flange and engaging said rear surface, the radial flange including a first aperture formed therein adjacent said first cylindrical portion;

a locking cylinder assembly disposed within said first throughbore such that said locking cylinder assembly is operably supported by said knob insert in said knob portion; and a shank portion having a second throughbore formed therein for receiving said second cylindrical flange portion, a first cover portion adapted to engage said rear surface of said knob portion and a second cover portion extending axially away from said first cover portion, said shank portion being releasably secured to said knob portion such that said knob insert is captured therebetween.

9. The knob assembly of claim 8 wherein said rear surface has a second aperture formed therein adjacent said bore, said knob assembly further comprising a threaded fastener extending through said first aperture and received in said second aperture to releasably secure said knob insert to said knob portion.

10. The knob insert of claim 9 further comprising a pair of radial flanges extending outwardly from said second cylindrical flange and engaging said rear surface, each of said pair of radial flanges having a first aperture formed therein adjacent said first cylindrical portion, and wherein said rear surface has a pair of second apertures formed therein adjacent said bore, said knob assembly further comprising a pair of fasteners extending through said first aperture and received in said second apertures to releasably secure said knob insert to said knob portion.

11. The knob assembly of claim 8 wherein said knob portion has a chimney cavity formed therein which communicates with said bore and receives a chimney extension from said lock cylinder.

12. The knob assembly of claim 11 wherein said knob insert has a tab extending outwardly from said second cylindrical flange, said tab engaging said rear surface and covering said chimney cavity.

13. The knob assembly of claim 11 wherein said knob insert has a slot formed in said first cylindrical flange and receives said chimney extension.

14. The knob assembly of claim 8 wherein said first cover portion of said shank portion has a first aperture formed therein adjacent said second cover portion, and wherein said rear surface has a second aperture formed therein adjacent said bore, said knob assembly further comprising a threaded aperture extending through said first aperture and received in said second aperture to releasably secure said shank portion to said knob portion.

15. The knob assembly of claim 8 wherein said shank portion has a channel formed on an inner annular surface defined by said throughbore which terminates at a radial slot, said radial slot adapted to receive a catch for releasably securing the knob assembly to a lockset chassis.

16. The knob assembly of claim 15 wherein said knob insert has a radial slot formed in an end of said second cylindrical flange which aligns with said radial slot formed in said shank portion.

17. The knob assembly of claim 8 wherein said knob portion is generally ellipsoidal.

* * * * *